United States Patent [19]

Jahnke

[11] 4,118,331

[45] Oct. 3, 1978

[54] METHOD FOR WORKING METAL AND LUBRICANTS FOR USE THEREIN

[75] Inventor: Richard William Jahnke, Mentor-on-the-Lake, Ohio

[73] Assignee: The Lubrizol Corporation, Wickliffe, Ohio

[21] Appl. No.: 758,525

[22] Filed: Jan. 11, 1977

Related U.S. Application Data

[63] Continuation-in-part of Ser. No. 574,675, May 5, 1975, abandoned, which is a continuation-in-part of Ser. No. 439,656, Feb. 4, 1974, abandoned, and Ser. No. 504,414, Sep. 9, 1974, abandoned.

[51] Int. Cl.[2] ..... C10M 1/48; C10M 3/42; C10M 5/24; B21B 45/02

[52] U.S. Cl. ..... 252/32.7 E; 72/42; 252/41; 252/56 D; 252/389 A

[58] Field of Search ..... 252/32.5, 389 A, 32.7 E, 252/56 D, 41; 72/42

[56] References Cited

U.S. PATENT DOCUMENTS

| | | | |
|---|---|---|---|
| 3,050,466 | 8/1962 | Heisig et al. | 252/56 D |
| 3,428,561 | 2/1969 | LeSuer | 252/32.5 |
| 3,676,348 | 7/1972 | Unick et al. | 252/54 |

FOREIGN PATENT DOCUMENTS

| | | | |
|---|---|---|---|
| 993,836 | 6/1965 | United Kingdom | 252/24 |

*Primary Examiner*—Irving Vaughn
*Attorney, Agent, or Firm*—James W. Adams, Jr.; William H. Pittman

[57] ABSTRACT

Lubricants useful in metal working processes, especially drawing, comprise an oil of lubricating viscosity; a carboxylic acid or derivative thereof, especially an anhydride of a hydrocarbon-substituted succinic acid in which the substituent contains about 6–30 carbon atoms; and a phosphorus acid salt, usually a zinc salt of a phosphorodithioic acid. The lubricant may also contain other ingredients, especially chlorinated wax or mixtures of aliphatic alcohols and hydrocarbons. Said lubricant provides improved lubricity, corrosion resistance, cleanability, anti-wear properties and extreme pressure properties when used in the working operation.

44 Claims, No Drawings

METHOD FOR WORKING METAL AND LUBRICANTS FOR USE THEREIN

This application is a continuation-in-part of copending application Ser. No. 574,675, filed May 5, 1975, which in turn is a continuation-in-part of applications Ser. No. 439,656, filed Feb. 4, 1974, and Ser. No. 504,414, filed Sept. 9, 1974, all now abandoned.

This invention relates to metal working operations and more particularly to a lubricant for use during such operations. Still more particularly, it relates to a method for lubricating metal during working thereof which comprises applying to said metal a composition comprising (A) an oil of lubricating viscosity, (B) at least one carboxylic acid or derivative thereof, and (C) at least one phosphorus acid salt having the formula

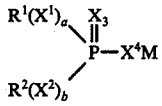

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$, $X^2$, $X^3$ and $X^4$ is oxygen or sulfur; and each of *a* and *b* is 0 or 1.

Metal working operations, for example, rolling, forging, hot-pressing, blanking, bending, stamping, drawing, cutting, punching, spinning and the like generally employ a lubricant to facilitate the same. Lubricants greatly improve these operations in that they can reduce the power required for the operation, prevent sticking and decrease wears of dies, cutting bits and the like. In addition, they frequently provide rust inhibiting properties to the metal being treated.

Since it is conventional to subject the metal to various chemical treatments (such as the application of conversion coating solutions) after working, a cleaning operation is necessary between the working step and the chemical treatment step. In addition to the above properties, therefore, it is preferred that the working lubricant be easily removable from the metal surface by ordinary cleaning compositions.

A principal object of the present invention, therefore, is to provide an improved metal working method.

A further object is to provide a method using lubricants which provide to the metal being worked a unique combination of properties including lubricity, corrosion resistance, extreme pressure properties and protection against wear of working parts, and which in addition are relatively easy to remove from the surface of the metal by cleaning after the working operation is completed.

Other objects will in part be obvious and will in part appear hereinafter.

The metal working compositions used in the method of this invention contain three essential components. Component A is an oil of lubricating viscosity. Both natural and synthetic oils are suitable. Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic oils (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)disiloxane, poly(methyl)siloxanes, poly(methylphenyl)siloxanes, etc.). Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used as component A according to this invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such refined oils are also known as reclaimed or reprocessed oils and often are additionally processed by techniques directed to removal of spent additives and oil breakdown products.

A particularly preferred mixture for use as component A is a mixture of ordinary mineral oil and a mineral oil fraction of the type generally identified as bright stock, especially such a mixture in which the weight ratio of bright stock to ordinary mineral oil is between about 0.5:1 and 5.0:1. The incorporation of bright stock in this amount frequently improves the viscosity characteristics of the metal working lubricant.

Component B is at least one carboxylic acid or derivative thereof. As used herein, the term "derivative" includes:

Anhydrides.

Esters, especially those prepared from lower alkyl (the word "lower" meaning up to 7 carbon atoms) monohydroxy or polyhydroxy compounds (e.g., methanol, ethanol, 1-butanol, n-hexanol, ethylene glycol, pentaerythritol) or epoxides (e.g., ethylene oxide, propylene oxide). The epoxide-derived compounds, as will be readily understood, are hydroxy esters.

Salts (neutral, acidic or basic) in which the cation is one of those listed hereinafter with reference to component C, including salts of the free acids and of their hydroxy esters. The lithium salts are preferred for their anti-rust properties.

Amides and amide-imide mixtures, especially those derived from aliphatic amines and more especially from lower aliphatic amines. The preferred amines are the alkylene polyamines, particularly ethylene polyamines.

Derivatives of the type described above may be obtained from the acids by known reactions or sequences of reactions.

The free acids, their lithium salts, and their anydrides are most useful as component B. Preferred are the aliphatic carboxylic acids (and derivatives thereof as defined hereinabove) containing about 6–75 and usually at least about 8 carbon atoms, and especially those in which the aliphatic radical is a hydrocarbon radical. Particularly desirable are the dibasic acids, especially the anhydrides of succinic acids having a hydrocarbon-based substituent, such as those prepared by the reaction (more fully described hereinafter) of maleic acid or maleic anhydride with a hydrocarbon-based compound containing at least about 6 carbon atoms, preferably about 6–75 and most often about 10–20 carbon atoms.

As used herein, the term "hydrocarbon-based" denotes a compound or radical having predominantly hydrocarbon character within the context of this invention. Hydrocarbon-based compounds thus include the following:

(1) Hydrocarbons, which are preferred and which may be aliphatic (e.g., alkanes or alkenes), alicyclic (e.g., cycloalkanes or cycloalkenes), aromatic, aliphatic- and alicyclic-substituted aromatic, aromatic-substituted aliphatic and alicyclic hydrocarbons and the like.

(2) Substituted hydrocarbons, that is, compounds containing non-hydrocarbon substituents which, in the context of this invention, do not alter the predominantly hydrocarbon character of the compound. Those skilled in the art will be aware of suitable substituents; examples are halide, hydroxy, nitro, cyano, $$RC(=O)-,\ HOC(=O)-,\ ROC(=O)-,\ H_2NC(=O)-,\ RNHC(=O)-,\ RS(=O)-,\ \text{and}\ RS(=O)_2-$$

(R being a hydrocarbon-based radical and preferably a lower alkyl radical).

(3) Hetero compounds; that is, compounds which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based compound.

The hydrocarbon-based compound used for the preparation of component B should be free from acetylenic unsaturation and substantially free from pendant groups containing more than about six aliphatic carbon atoms.

The preferred hydrocarbon-based compounds are those derived from substantially saturated petroleum fractions and olefin polymers, particularly oligomers of monoolefins (especially terminal monoolefins) having from 2 to about 10 carbon atoms. Thus, the hydrocarbon-based compound may be derived from a polymer of ethylene, propene, 1-butene, 2-butene, isobutene, 3-pentene, 1-octene or the like. Also useful are interpolymers of more than one olefin such as those illustrated above or of such olefins and other polymerizable olefinic substances such as styrene, chloroprene, isoprene, p-methylstyrene, piperylene and the like. In general, these interpolymers should contain at least about 80%, preferably at least about 96%, on a weight basis of units derived from the aliphatic monoolefins.

Other suitable hydrocarbon-based compounds are mixtures of saturated aliphatic hydrocarbons such as highly refined high molecular weight white oils or synthetic alkanes.

In some instances, the hydrocarbon-based compound should contain an activating polar radical to facilitate its reaction with the low molecular weight acid-producing compound. The preferred activating radicals are halogen atoms, especially chlorine, but other suitable radicals include sulfide, disulfide, nitro, mercaptan, ketone and aldehyde groups.

As previously noted, the preferred method for producing component B is by the reaction of maleic acid or anhydride with the hydrocarbon-based compound, especially with a material such as a propene oligomer. This reaction involves merely heating the two reactants at about 100–200° C. in the presence or absence of a substantially inert organic liquid diluent; an excess of a liquid reactant may also serve as the reaction medium. Other suitable reactions for the preparation of component B include oxidation with potassium permanganate, nitric acid or a similar oxidizing agent of a hydrocarbon-substituted 1,4-butanediol or the like; ozonolysis of a hydrocarbon-substituted 1,5-diene or the like; preparation of a bis-organometallic derivative of a hydrocarbon-substituted 1,2-dihalide or the like, followed by carbonation thereof with carbon dioxide; or preparation of a dinitrile followed by its hydrolysis. All of these reactions are well known in the art, as are the substituted succinic acids and derivatives thereof produced thereby.

Component C is a phosphorus acid salt having the above formula. As indicated, each of $R^1$ and $R^2$ therein is a hydrocarbon-based radical. That term, as previously noted, denotes a radical having a carbon atom directly attached to the remainder of the molecule and being hydrocarbon-based as defined hereinabove. Preferably, $R^1$ and $R^2$ are free from acetylenic and usually also from ethylenic unsaturation and have no more than about 30 carbon atoms, desirably no more than about 12 carbon atoms. They are usually hydrocarbon radicals such as methyl, ethyl, propyl, butyl, amyl, hexyl, octyl, decyl, dodecyl, vinyl, decenyl, cyclohexyl, phenyl and the like, all isomers thereof being included, or halo-substituted (i.e., chloro-, bromo- or iodo-substituted) hydrocarbon radicals and especially haloaryl (e.g., chlorophenyl), haloaryl radicals being of interest especially when *a* and *b* are both zero. A particular preference is expressed for compounds in which $R^1$ and $R^2$ are hydrocarbon and especially lower alkyl radicals, the word "lower" being defined hereinabove.

It will be apparent that the phosphorus acids from which the salts are derived include dialkylphosphoric acids, dialkylphosphinic acids, and thio derivatives of such acids. Especially preferred are the salts of acids in which $X^3$ and $X^4$ are both sulfur; these include phosphorodithioic acids (in which *a* and *b* are each 1 and $X^1$ and $X^2$ are each oxygen) and phosphinodithioic acids (in which *a* and *b* are zero and $X^1$ and $X^2$ are oxygen). The phosphorodithioic acid salts are most desirable. In any of these salts, M may be any of the metals previously enumerated or ammonium; the latter term includes substituted ammonium salts (i.e., amine salts). M is preferably zinc or lead, especially zinc.

It is also within the scope of this invention to use mixtures of the aforementioned compounds as components B and/or C (e.g., a mixture of carboxylic acids or a mixture of an anhydride and a lithium salt as component B, a mixture of salts of different phosphorodithioic acids or of a salt of a phosphorodithioic and a phosphinodithioic acid as component C) and to incorporate other additives into the drawing lubricant. Such other additives include:

Antioxidants, typically hindered phenols.

Surfactants, usually nonionic surfactants such as oxyalkylated phenols and the like.

Auxiliary extreme pressure agents such as chlorinated waxes (which are preferred), sulfurized hydrocarbons, sulfurized esters, etc.

Corrosion and wear inhibiting agents, and auxiliary rust inhibiting agents.

Anti-stain agents such as salts of petrosulfonic acids, especially alkali metal salts and preferably sodium salts.

Friction modifying agents, of which the following are illustrative: Alkyl or alkenyl phosphates or phosphites in which the alkyl or alkenyl group contains about 10-40 carbon atoms, and metal salts thereof, especially zinc salts; $C_{10-20}$ fatty acid amides; $C_{10-20}$ alkyl amines, especially tallow amines, and ethoxylated derivatives thereof; salts of such amines with acids such as boric acid or phosphoric acid which have been partially esterified as noted above; $C_{10-20}$ alkyl-substituted imidazolines and similar nitrogen heterocycles; sulfurized derivatives of sperm oil and other fatty oils; basic barium or calcium salts of such oils or of amine-formaldehyde condensates, especially those derived from tallow amines such as described above; and gels derived from basic alkaline earth metal sulfonates.

Thixotropic or non-drip agents. These may include waxes and mixtures of aliphatic alcohols and hydrocarbons, especially those in about the $C_{20-34}$ range. Such alcohol-hydrocarbon mixtures are disclosed in U.S. Pat. No. 3,676,348, which is incorporated by reference herein for its disclosure thereof. The thixotropic agent need not be totally soluble in the remainder of the lubricant at ambient temperatures. A preferred thixotropic agent is a commercially available solid mixture of linear and branched chain $C_{20-30}$ alcohols and $C_{24-40}$ hydrocarbons melting at about 45°–50° C., sold by Ethyl Corporation under the trademark "Epal 20+".

The relative proportions of the ingredients in the metal working lubricants useful in the method of this invention are not critical. Generally, it is convenient to use about 0.5–5.0 parts by weight of component B per part of component C, and the combination of those components comprises about 3–30% by weight, preferably about 10–25%, of the lubricant. Thixotropic agents, if present, may comprise about 10–30% (preferably about 15–25%), and other additives (e.g., chlorinated wax) about 3–20%, of the lubricant. The balance thereof is component A.

It is preferred that components B and C be soluble in component A, but the method of this invention also contemplates the use of substantially stable dispersions comprising components A, B and C, as well as solutions.

The constitution of typical lubricants suitable for use in the method of this invention is given in Table I.

TABLE I

| | Parts by Weight | | | | | | | | | | |
|---|---|---|---|---|---|---|---|---|---|---|---|
| Ingredient | A | B | C | D | E | F | G | H | J | K | L |
| Mineral oil | 75.65 | 13.65 | 26.65 | 88.5 | 14.9 | 39.3 | 43.55 | 12.9 | 93.1 | 92.5 | 18.8 |
| Bright stock mineral oil | — | 62 | 45 | — | 64 | 28.8 | 32.1 | 58.9 | — | — | 46.0 |
| Tetrapropenylsuccinic anhydride | 20 | 20 | 19 | 8 | 8 | — | 20 | — | — | — | — |
| Polyisobutene (mol.wt. about 1000)-substituted succinic anhydride | — | — | — | — | — | 18 | — | 19 | — | — | 5.8 |
| Lithium salt of polybutenyl (mol.wt. about 1000)-substituted succinic acid in which the | | | | | | | | | | | |

TABLE I-continued

| Ingredient | A | B | C | D | E | F | G | H | J | K | L |
|---|---|---|---|---|---|---|---|---|---|---|---|
| | Parts by Weight | | | | | | | | | | |
| polybutenyl units are principally polyisobutenyl | — | — | — | — | — | — | — | — | 4 | 4 | — |
| Zinc salt of mixed isobutyl (65 mole %)- and primary amyl (35 mole %)-phosphorodithioic acid | 4.35 | 4.35 | 4.35 | 3.5 | 13.1 | 3.9 | 4.35 | — | — | 3.5 | 9.4 |
| Zinc salt of tetrapropenylphenylphosphorodithioic acid | — | — | — | — | — | — | — | — | 2.9 | — | — |
| Lead isooctylphosphorodithioate | — | — | — | — | — | — | — | 4.2 | — | — | — |
| Chlorinated wax (about 42% chlorine) | — | — | 5 | — | — | 10 | — | 5 | — | — | — |
| "Epal 20+" alcohol-hydrocarbon mixture | — | — | — | — | — | — | — | — | — | — | 20.0 |

Any metal to be worked may be treated according to the method of this invention; examples are ferrous metals, aluminum, copper, magnesium, titanium, zinc and manganese as well as alloys thereof and alloys containing other elements such as silicon.

The compositions used in the method of this invention can be applied to the metal workpiece prior to or during the working operation in any suitable manner. They may be applied to the entire surface of the metal, or with any portion of that surface with which contact is desired. For example, the lubricant can be brushed or sprayed on the metal, or the metal can be immersed in a bath of the lubricant. In high speed metal forming operations spraying or immersion are preferred.

In a typical embodiment of the method of this invention, a ferrous metal workpiece is coated with the lubricant prior to the working operation. For example, if the workpiece is to be drawn it may be coated with the lubricant before passage through the drawing die. It is also within the scope of the invention to apply the lubricant to the workpiece as it enters the die, or to apply it to the die itself whereupon it is transferred to the workpiece by contact. Thus, the method of this invention in a generic sense comprises any metal working operation wherein the workpiece has on its surface, during said operation, the above-described lubricant regardless of how applied.

The lubricity properties of the compositions used in the method of this invention are demonstrated in a test in which a cold-rolled steel strip, 2 × 13½ inches, is drawn between two dies in an Instron Universal Tester, Model TT-C. Prior to drawing, the edges of the strip are deburred and the strip is vapor degreased and wiped with a clean cloth. It is then coated with the drawing lubricant and mounted in the testing machine. The dies are tightened by means of a torque wrench set at 40 foot-pounds torque and the strip is pulled through the die for 2 inches at the rate of 5 inches per minute. The force (or "load") required to pull the strip through the die is recorded on a chart; if there is "chattering" and irregular movement due to friction, the deviation from a uniform load is also recorded on the chart. When a number of lubricants are being compared, the tests are all run on the same day on strips from the same sheet of steel.

The results of several lubricity tests are given in Table II. The "Load" readings are those at the end of the 2-inch drawing period. All tests were run at room temperature. The entry marked "Control 1" is a commercial chlorinated wax drawing lubricant sold by D. A. Stuart Oil Co., Ltd., under the designation "T13-B"; that marked "Control 2" is a rust inhibiting drawing oil sold by Quaker Chemical Corp. under the designation "Ferro Cote"; and that marked "Control 3" comprises successive treatments with "Ferro Cote" and a fatty acid ester drawing lubricant sold by Quaker Chemical Corp. under the designation "Quaker 693M".

TABLE II

| Test | Lubricant | Load, lbs. | Deviation |
|---|---|---|---|
| 1 | Control 1 | 1125 | 40 |
| | C | 1125 | 25 |
| 2 | Control 2 | 1750 | 75 |
| | A | 1925 | 0 |
| 3 | Control 3 | 1750 | 0 |
| | A | 1825 | 0 |
| 4 | A | 1750 | 0 |
| | B | 1100 | 0 |
| | G | 1500 | 0 |
| 5 | B | 1350 | 0 |
| | C | 1500 | 0 |
| 6 | L | 1450 | 0 |

The extreme pressure properties of the lubricants are measured by means of the SAE Test, in which two Timken cups on shafts are operated in contact with each other at a relative speed of 500 rpm. in a bath of test lubricant as a load is gradually and automatically applied. The load at which scoring occurs is the test result. When tested by this method, the results listed in Table III were obtained.

TABLE III

| Lubricant | Load, lbs. |
|---|---|
| Control 1 | 147 |
| B | 102 |
| C | 111 |

The anti-wear properties of the lubricants are evaluated by the 4-Ball Wear Test (ASTM D 2266), in which a steel ball lubricated with the lubricant being tested is rotated in contact with three other similar balls for one hour at 1200 rpm., under a 40-kilogram load at room temperature. The diameter of the scar on the rotated ball is a measure of the amount of wear. The results in Table IV were obtained.

TABLE IV

| Lubricant | Scar diameter, mm. |
|---|---|
| A | 0.48 |

TABLE IV-continued

| Lubricant | Scar diameter, mm. |
|---|---|
| G | 0.48 |

To evaluate cleanability, steel panels were coated with the drawing lubricants and were then cleaned by means of a commercial cleaner containing potassium hydroxide, sodium silicate and the sodium salt of ethylenediaminetetraacetic acid. The cleaning is effected at 160° F. by spraying the cleaner for one minute on the metal surface at 10 psi. The percentage of soil removed is measured, and the degree of foaming and extent of "water breaks" are determined by inspection. When evaluated in this way, Lubricants A and B both were removed 100% from the surfaces, with no foaming or water breaks in evidence.

Resistance to corrosion was measured by coating panels with the drawing lubricant and hanging them, coated side down, about 6–8 inches above water in a cabinet maintained at 135° F. They remained in that cabinet for a predetermined period of time, after which the percentage of rust was determined by inspection. When evaluated in this way, a panel coated with Lubricant A showed no rust after 66 hours and 10% rust after 96 hours.

As indicated by the above test results, the lubricants used in the method of this invention are comparable to lubricants previously available in a large number of diverse properties, all of which are important in metal working.

What is claimed is:

1. A method for lubricating metal during working thereof which comprises applying to said metal a composition free from elemental sulfur and triaryl phosphates and comprising (A) an oil of lubricating viscosity, (B) at least one substituted succinic acid in which the substituent is a hydrocarbon-based substituent containing 6–75 carbon atoms of an anhydride or lithium salt thereof, and (C) at least one phosphorus acid salt having the formula

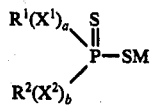

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$ and $X^2$ is oxygen or sulfur; and each of *a* and *b* is 0 or 1; components B and C comprising about 3–30% by weight of said composition and about 0.5–5.0 parts by weight of component B being present per part of component C.

2. A method according to claim 1 wherein M is zinc or lead, each of $R^1$ and $R^2$ is a hydrocarbon radical, $X^1$ and $X^2$ are oxygen, and *a* and *b* are each 1.

3. A method according to claim 2 wherein each of $R^1$ and $R^2$ is a lower alkyl radical and M is zinc.

4. A method according to claim 3 wherein component B is tetrapropenyl succinic anhydride, each of $R^1$ and $R^2$ is a lower alkyl radical, and M is zinc.

5. A method according to claim 4 wherein component C is the zinc salt of a mixed isobutyl- and primary amylphosphorodithioic acid.

6. A method according to claim 5 wherein the working comprises drawing.

7. A method according to claim 3 wherein said composition additionally contains a chlorinated wax.

8. A method according to claim 7 wherein component B is tetrapropenyl succinic anhydride, each of $R^1$ and $R^2$ is a lower alkyl radical, and M is zinc.

9. A method according to claim 8 wherein component C is the zinc salt of a mixed isobutyl- and primary amylphosphorodithioic acid.

10. A method according to claim 8 wherein the working comprises drawing.

11. A method according to claim 3 in which component B is the lithium salt of a polybutenyl succinic anhydride in which the polybutene substituent has a molecular weight of about 1000, each of $R^1$ and $R^2$ is a lower alkyl radical, and M is zinc.

12. A method according to claim 11 wherein component C is the zinc salt of a mixed isobutyl- and primary amylphosphorodithioic acid.

13. A method according to claim 12 wherein the working comprises drawing.

14. A method according to claim 3 wherein the composition additionally contains a thixotropic agent.

15. A method according to claim 14 wherein the thixotropic agent comprises a mixture of linear and branched chain $C_{20-30}$ alcohols and $C_{24-40}$ hydrocarbons, said mixture melting at about 45°–50° C.

16. A method according to claim 15 wherein component B is tetrapropenyl succinic anhydride, each of $R^1$ and $R^2$ is a lower alkyl radical, and M is zinc.

17. A method according to claim 16 wherein component C is the zinc salt of a mixed isobutyl- and primary amylphosphorodithioic acid.

18. A method according to claim 17 wherein the working comprises drawing.

19. A method according to claim 15 wherein said composition additionally contains a chlorinated wax.

20. A method according to claim 19 wherein component B is tetrapropenyl succinic anhydride, each of $R^1$ and $R^2$ is a lower alkyl radical, and M is zinc.

21. A method according to claim 20 wherein component C is the zinc salt of a mixed isobutyl- and primary amylphosphorodithioic acid.

22. A method according to claim 21 wherein the working comprises drawing.

23. A method according to claim 15 in which component B is the lithium salt of a polyisobutenyl succinic anhydride in which the polyisobutene substituent has a molecular weight of about 1000, each of $R^1$ and $R^2$ is a lower alkyl radical, and M is zinc.

24. A method according to claim 23 wherein component C is the zinc salt of a mixed isobutyl- and primary amylphosphorodithioic acid.

25. A method according to claim 24 wherein the working comprises drawing.

26. A metal workpiece having on its surface a film of a composition free from elemental sulfur and triaryl phosphates and comprising (A) an oil of lubricating viscosity, (B) at least one substituted succinic acid in which the substituent is a hydrocarbon-based substituent containing 6–75 carbon atoms or an anhydride or lithium salt thereof, and (C) at least one phosphorus acid salt having the formula

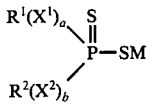

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$ and $X^2$ is oxygen or sulfur; and each of *a* and *b* is 0 or 1; components B and C comprising about 3–30% by weight of said composition and about 0.5–5.0 parts by weight of component B being present per part of component C.

27. A workpiece according to claim 26 wherein M is zinc or lead; each of $R^1$ and $R^2$ is a hydrocarbon radical; $X^1$ and $X^2$ are oxygen; and *a* and *b* are each 1.

28. A workpiece according to claim 27 wherein each of $R^1$ and $R^2$ is a lower alkyl radical and M is zinc.

29. A workpiece according to claim 27 wherein component A is mineral oil and component B is at least one carboxylic acid or an anhydride or lithium salt thereof.

30. A workpiece according to claim 29 wherein component C is the zinc salt of a mixed isobutyl- and primary amylphosphorodithioic acid.

31. A workpiece according to claim 29 wherein said composition additionally contains a chlorinated wax.

32. A workpiece according to claim 31 wherein component B is tetrapropenyl succinic anhydride, each of $R^1$ and $R^2$ is a lower alkyl radical, and M is zinc.

33. A workpiece according to claim 32 wherein component C is the zinc salt of a mixed isobutyl- and primary amylphosphorodithioic acid.

34. A workpiece according to claim 29 in which component B is the lithium salt of a polybutenyl succinic anhydride in which the polybutene substituent has a molecular weight of about 1000, each of $R^1$ and $R^2$ is a lower alkyl radical, and M is zinc.

35. A workpiece according to claim 34 wherein component C is the zinc salt of a mixed isobutyl- and primary amylphosphorodithioic acid.

36. A workpiece according to claim 29 wherein the composition additionally contains a thixotropic agent.

37. A workpiece according to claim 36 wherein the thixotropic agent comprises a mixture of linear and branched chain $C_{20-30}$ alcohols and $C_{24-40}$ hydrocarbons, said mixture melting at about 45°–50° C.

38. A workpiece according to claim 37 wherein component B is tetrapropenyl succinic anhydride, each of $R^1$ and $R^2$ is a lower alkyl radical, and M is zinc.

39. A workpiece according to claim 38 wherein component C is the zinc salt of a mixed isobutyl- and primary amylphosphorodithioic acid.

40. A workpiece according to claim 37 wherein said composition additionally contains a chlorinated wax.

41. A workpiece according to claim 40 wherein component B is tetrapropenyl succinic anhydride, each of $R^1$ and $R^2$ is a lower alkyl radical, and M is zinc.

42. A workpiece according to claim 41 wherein component C is the zinc salt of a mixed isobutyl- and primary amylphosphorodithioic acid.

43. A workpiece according to claim 37 in which component B is the lithium salt of a polyisobutenyl succinic anhydride in which the polyisobutene substituent has a molecular weight of about 1000, each of $R^1$ and $R^2$ is a lower alkyl radical, and M is zinc.

44. A workpiece according to claim 43 wherein component C is the zinc salt of a mixed isobutyl- and primary amylphosphorodithioic acid.

* * * * *

UNITED STATES PATENT AND TRADEMARK OFFICE

CERTIFICATE OF CORRECTION

PATENT NO. : 4,118,331

DATED : Oct. 3, 1978

INVENTOR(S) : Richard William Jahnke

It is certified that error appears in the above-identified patent and that said Letters Patent are hereby corrected as shown below:

Column 9, line 40 (that is, line 7 of claim 1), "of" should read --or--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*